US010320087B2

(12) United States Patent
Miraftab et al.

(10) Patent No.: US 10,320,087 B2
(45) Date of Patent: Jun. 11, 2019

(54) OVERLAPPING LINEAR SUB-ARRAY FOR PHASED ARRAY ANTENNAS

(71) Applicant: Huawei Technologies Co., Ltd., Shenzhen (CN)

(72) Inventors: Vahid Miraftab, Kanata (CA); Wenyao Zhai, Kanata (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 47 days.

(21) Appl. No.: 14/997,288

(22) Filed: Jan. 15, 2016

(65) Prior Publication Data

US 2017/0207545 A1 Jul. 20, 2017

(51) Int. Cl.

| | |
|---|---|
| ***H01Q 3/30*** | (2006.01) |
| ***H01Q 21/00*** | (2006.01) |
| ***H01Q 5/307*** | (2015.01) |
| ***H01Q 3/36*** | (2006.01) |
| ***H01Q 21/06*** | (2006.01) |
| ***H01Q 21/30*** | (2006.01) |

(52) U.S. Cl.

CPC ..... *H01Q 21/0075* (2013.01); *H01Q 3/36* (2013.01); *H01Q 5/307* (2015.01); *H01Q 21/005* (2013.01); *H01Q 21/065* (2013.01); *H01Q 21/30* (2013.01)

(58) Field of Classification Search

CPC ... H01Q 21/0075; H01Q 5/307; H01Q 21/005

USPC ..... 343/893

See application file for complete search history.

(56) References Cited

U.S. PATENT DOCUMENTS

| | | | | |
|---|---|---|---|---|
| 4,937,585 A * | 6/1990 | Shoemaker | H01Q 3/36 | 343/700 MS |
| 5,210,541 A * | 5/1993 | Hall | H01Q 21/0075 | 343/700 MS |
| 5,557,291 A * | 9/1996 | Chu | H01Q 5/42 | 343/725 |
| 5,952,964 A * | 9/1999 | Chan | H01Q 3/22 | 342/368 |
| 6,043,791 A * | 3/2000 | Kinsey | H01Q 3/26 | 343/754 |
| 6,104,343 A | 8/2000 | Brookner et al. | | |

(Continued)

FOREIGN PATENT DOCUMENTS

| | | |
|---|---|---|
| DE | 3839945 A1 | 5/1990 |
| RU | 2282921 C1 | 8/2006 |

OTHER PUBLICATIONS

Mailloux et.al, 'Irregular Polyomino-Shaped Subarrays for Space-Based Active Arrays', International Journal of Antennas and Propagation, Hindawi Publishing Corporation, vol. 2009, Article ID 956524.

(Continued)

*Primary Examiner* — Dieu Hien T Duong
*Assistant Examiner* — Bamidele A Jegede

(57) ABSTRACT

A phased array antenna is described that groups radiating elements into rows and columns. The radiating elements in a row are fed by a common phase shifted signal and the radiating elements in a column are fed by a common phase shifted signal. As such, each radiating element is fed by two different phase shifters. The overlapping groupings of rows and columns allows the antenna to be electronically steered by varying the phase shift applied to the rows and columns. The overlapped sub-arrays of the phased array antenna reduces the number of required phase shifters for the antenna array.

17 Claims, 14 Drawing Sheets

(56) References Cited

U.S. PATENT DOCUMENTS 6,154,176 A * 11/2000 Fathy ..... H01Q 1/38 343/700 MS
6,642,908 B2 * 11/2003 Pleva ..... B60K 31/0008 343/700 MS
7,420,522 B1 * 9/2008 Steinbrecher ..... H01Q 17/008 343/853
7,489,283 B2 * 2/2009 Ingram ..... H01Q 3/26 342/371
7,742,000 B2 * 6/2010 Mohamadi ..... H01Q 21/0025 343/700 MS
8,077,109 B1 12/2011 Roberts et al.
2012/0050107 A1 * 3/2012 Mortazawi ..... H01Q 21/0006 342/372
2014/0375525 A1 * 12/2014 Shi ..... H01Q 21/0037 343/893
2015/0318622 A1 * 11/2015 Pruett ..... H01Q 21/0006 343/876
2016/0204509 A1 7/2016 Thai et al.
2016/0218438 A1 7/2016 Miraftab et al.

OTHER PUBLICATIONS

Abbaspour-Tamijani et al., 'An Affordable Millimeter-Wave Beam-Steerable Antenna Using Interleaved Planar Subarrays', IEEE Transactions on Antennas and Propagation, vol. 51, No. 9, Sep. 2003.
Sanadgol et al., '60 GHz Substrate Integrated Waveguide Fed Steerable LTCC Antenna Array', 2010 IEEE Antennas and Propagation (EuCAP), Proceedings of the Fourth European Conference, May 2010.
U.S. Appl. No. 14/997,337, "Phased Array Antenna Having Sub-Arrays," filed Jan. 15, 2016.
International Search Report for PCT/CN2016/076771 dated Sep. 27, 2016.
English Abstract of DE3839945A1.

* cited by examiner

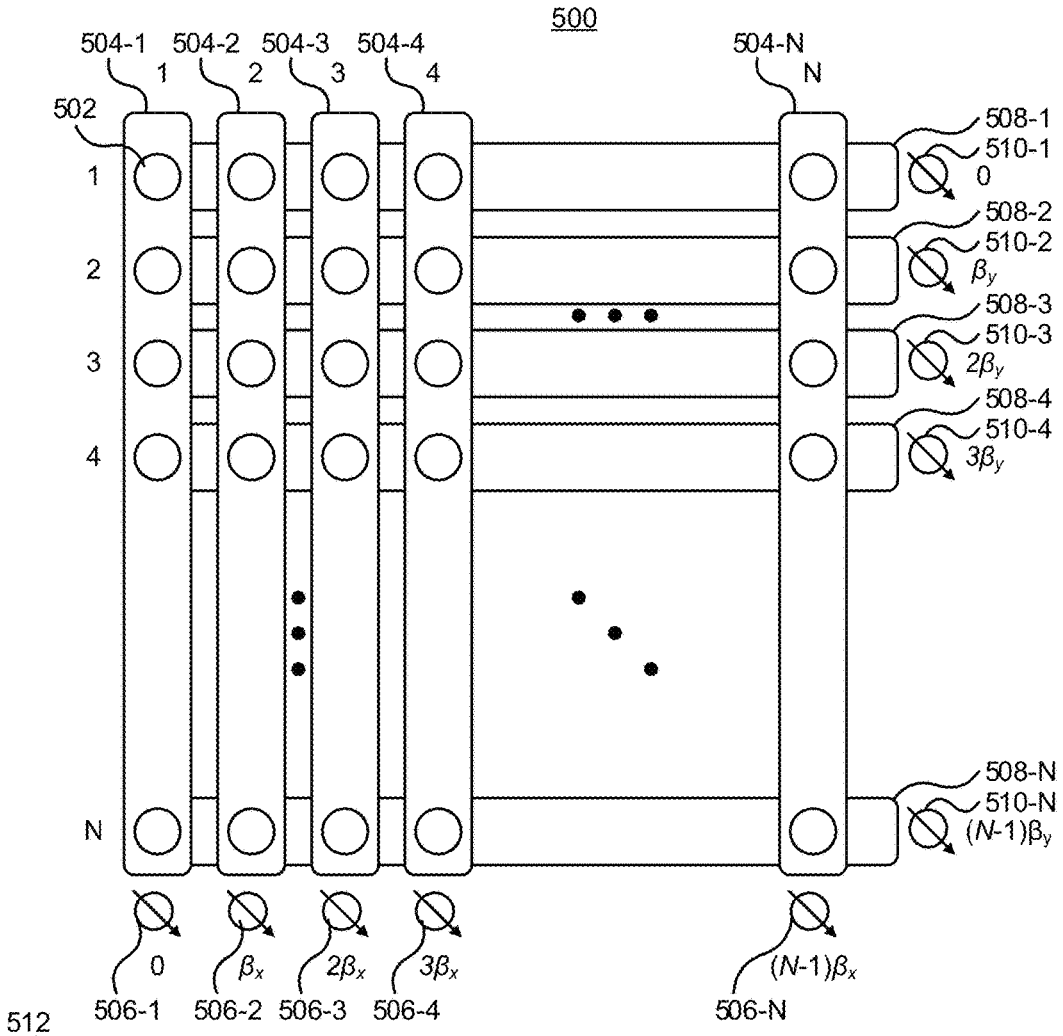

512

$$\begin{bmatrix} 0 & \beta_x & 2\beta_x & 3\beta_x & \cdots & (N\text{-}1)\beta_x \\ \beta_y & \beta_x + \beta_y & 2\beta_x + \beta_y & 3\beta_x + \beta_y & \cdots & (N\text{-}1)\beta_x + \beta_y \\ 2\beta_y & \beta_x + 2\beta_y & 2\beta_x + 2\beta_y & 3\beta_x + 2\beta_y & \cdots & (N\text{-}1)\beta_x + 2\beta_y \\ 3\beta_y & \beta_x + 3\beta_y & 2\beta_x + 3\beta_y & 3\beta_x + 3\beta_y & \cdots & (N\text{-}1)\beta_x + 3\beta_y \\ \vdots & \vdots & \vdots & \vdots & \ddots & \vdots \\ (N\text{-}1)\beta_y & \beta_x + (N\text{-}1)\beta_y & 2\beta_x + (N\text{-}1)\beta_y & 3\beta_x + (N\text{-}1)\beta_y & \cdots & (N\text{-}1)\beta_x + (N\text{-}1)\beta_y \end{bmatrix}$$

Figure 5

OVERLAPPING LINEAR SUB-ARRAY FOR PHASED ARRAY ANTENNAS

TECHNICAL FIELD

The current disclosure relates to phased array antennas for use in communication systems and in particular to an overlapping linear sub-array for feeding phased array antennas.

BACKGROUND

Phase array antenna can be used in a variety of different wireless communication networks, and they can be used to enable steering of the transmission and/or reception in both the azimuth and elevation planes. Steering transmission and reception allows for an antenna array to direct the transmission or reception resources towards a particular location, which can increase the system capacity, that is networks designed to provide service to mobile devices, there is increased interest in beam steering as it allows for better concentration of connectivity resources to the locations that need them. A relatively large array is required in order to achieve desirable directivity. In conventional phased array design there is one phase shifter, delay line and/or amplitude control per array element. This increases both the cost and complexity of manufacture of the array. In order to reduce system complexity there is a need to reduce the amount of control circuitry. Sub-array antenna designs are used to group a small amount of array elements together and use only one phase shifter or delay line to drive the group of array elements. However using sub-arrays can result in grating lobes as well as reduce the array's steerability.

It is desirable to have an additional, alternative and/or improved phased array antenna design for communication systems.

SUMMARY

In accordance with the present disclosure there is provided an antenna array comprising: a plurality of array elements arranged in a grid; a first feed network in a first substrate layer comprising a plurality of column signal feeds each column signal feed connected to array elements of a respective one of a plurality of columns of the grid; and a second feed network in a second substrate layer comprising a plurality of row signal feeds each row signal feed connected to array elements of a respective one of a plurality of rows of the grid.

In a further embodiment of the antenna array, the plurality of column signal feeds are provided by microstrips within the first substrate layer.

In a further embodiment of the antenna array, the plurality of column signal feeds are provided by substrate integrated waveguides (SIWs) within the first substrate layer.

In a further embodiment of the antenna array, the plurality of row signal feeds are provided by microstrips within the first substrate layer.

In a further embodiment of the antenna array, the plurality of row signal feeds are provided by substrate integrated waveguides (SIWs) within the first substrate layer.

In a further embodiment of the antenna array, the plurality of array elements are provided by isotropic array elements.

In a further embodiment of the antenna array, the plurality of array elements are provided by patch array elements.

In a further embodiment, the antenna array further comprises a plurality of phase shifters each of the phase shifters associated with a respective one of the plurality of column signal feeds and the plurality of row signal feeds.

In a further embodiment of the antenna array, the grid comprises N columns and M rows, and wherein the antenna array comprises N+M phase shifters.

In a further embodiment of the antenna array, wherein N=M.

In a further embodiment of the antenna array, a column phase progression is $2\beta_x$ and a row phase progression is $2\beta_y$, where:

$$\begin{cases} \beta_x = -k \cdot d_x \sin\theta_o \cos\varphi_o \\ \beta_y = -k \cdot d_y \sin\theta_o \sin\vartheta_o \end{cases};$$

k is a phase number defined by $$k = \frac{2 \cdot \pi}{\lambda};$$

and $\vartheta_o$ and $\varphi_o$ are beam steering directions.

In a further embodiment, the antenna array further comprises a plurality of secondary array elements arranged in a secondary grid having a spacing between secondary array elements greater than a spacing between array elements of the grid, a third feed network in the first substrate layer comprising a plurality of secondary column signal feeds each secondary column signal feed coupled to secondary array elements of a respective one of the plurality of columns of the secondary grid; and a fourth feed network in the second substrate layer comprising a plurality of secondary row signal feeds each secondary row signal feed coupled to secondary array elements of a respective one of the plurality of rows of the secondary grid.

In accordance with the present disclosure there is provided a phased array system comprising: an antenna array comprising: a plurality of array elements arranged in a grid; a first feed network in a first substrate layer comprising a plurality of column signal feeds each column signal feed connected to array elements of a respective one of a plurality of columns of the grid; and a second feed network in a second substrate layer comprising a plurality of row signal feeds each row signal feed connected to array elements of a respective one of a plurality of rows of the grid; and a controller for determining a first phase shift to apply between adjacent columns of the plurality of columns and a second phase shift to apply between adjacent rows of the plurality of rows in order to control a desired steering angle of a main beam of the phased array system.

In a further embodiment of the phased array system, the phased array system comprises a dual-band phased array system, wherein the antenna array comprises a subset of the plurality of array elements arranged in a plurality of rows and a plurality of columns, each of the array elements of the subset having a greater spacing between array elements than a spacing between the plurality of array elements, each array element of the subset comprising: a primary array element coupled to the first and second feed networks; and a secondary array element, the antenna array further comprising: a third feed network in the first substrate layer comprising a plurality of secondary column signal feeds each secondary column signal feed coupled to secondary array elements of a respective one of the plurality of columns of the subset of array elements; and a fourth feed network in the second substrate layer comprising a plurality of secondary row signal feeds each secondary row signal feed coupled to secondary array elements of a respective one of the plurality of rows of the subset of array elements.

In a further embodiment of the phased array system, the plurality of column signal feeds are provided by one of: microstrips within the first substrate layer; and substrate integrated waveguides (SIWs) within the first substrate layer.

In a further embodiment of the phased array system, the plurality of row signal feeds are provided by one of: microstrips within the first substrate layer; and substrate integrated waveguides (SIWs) within the first substrate layer.

In a further embodiment, the phased array system further comprises a plurality of phase shifters each of the phase shifters associated with a respective one of the plurality of column signal feeds and the a plurality of row signal feeds.

In a further embodiment of the phased array system, the plurality of phase shifters are part of the controller.

In a further embodiment of the phased array system, the grid comprises N columns and M rows, and wherein the antenna array comprises N+M phase shifters.

In a further embodiment of the phased array system, a column phase progression is $2\beta_x$ and a row phase progression is $2\beta_y$, where:

$$\begin{cases} \beta_x = -k \cdot d_x \sin\theta_o \cos\varphi_o \\ \beta_y = -k \cdot d_y \sin\theta_o \sin\vartheta_o \end{cases},$$

κ is a phase number defined by $$k = \frac{2 \cdot \pi}{\lambda};$$

and $\vartheta_o$ and $\varphi_o$ are beam steering directions.

BRIEF DESCRIPTION OF THE DRAWINGS

Embodiments are described herein with reference to the appended drawings, in which:

FIG. 5 depicts a schematic of an overlapping linear sub-array;

DETAILED DESCRIPTION

Figure 1:
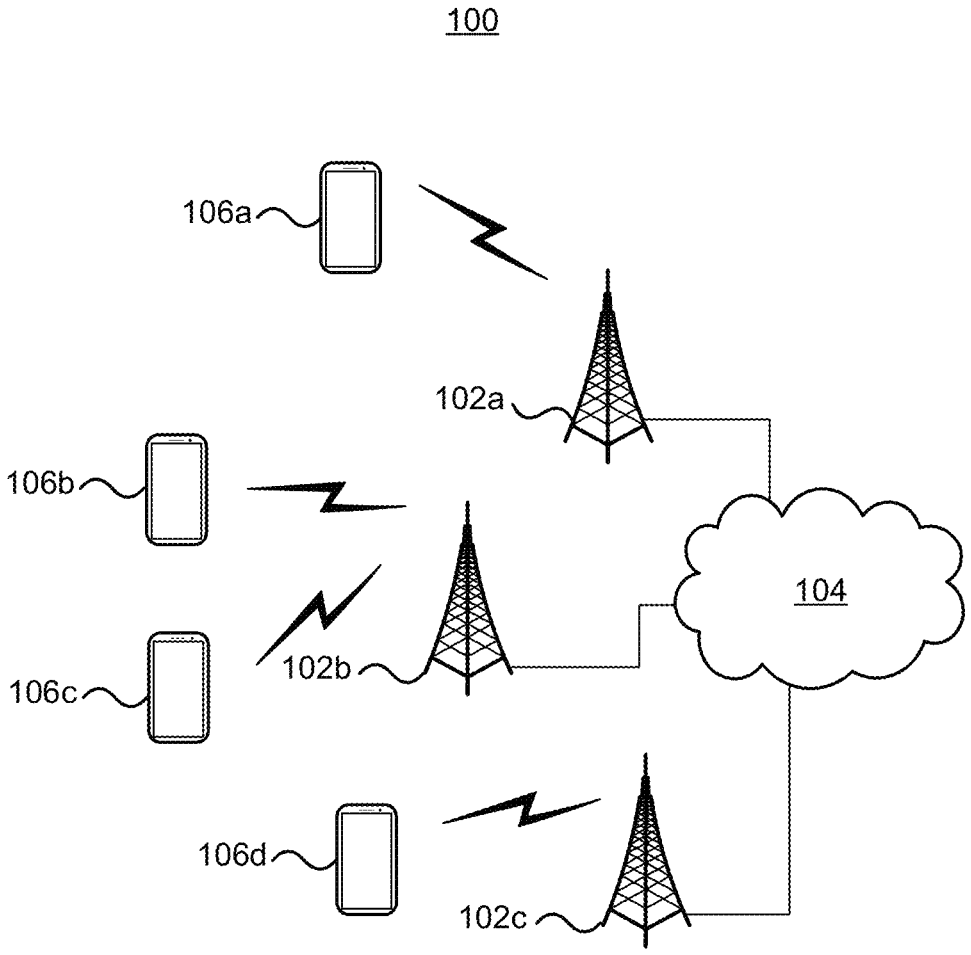
FIG. 1 depicts a simplified wireless communication system.

FIG. 1 depicts a simplified wireless communication system. As depicted a number of base-stations or transceivers 102*a*, 102*b*, 102*c* (referred to collectively as transceivers 102) are connected to network 104. Network 104 is a mobile network that can provide services to mobile devices and can provide at least one of data and voice service. By connecting to network 104 through access points such as transceivers 102, a mobile device can be connected to other networks including the Internet. The transceivers 102 may each communicate with one or more mobile devices, which are depicted as mobile devices 106*a*, 106*b*, 106*c*, and 106*d* (referred to collectively as mobile devices 106) over a wireless connection. Both the mobile devices 106 and transceivers 102 each include one or more radio antennas for transmitting and receiving radio frequency (RF) signals. In many networks, when transceivers 102*a*, 102*b*, 102*c* can utilize phased array antennas, it is possible to improve directivity and therefore network efficiency. Those skilled in the art will appreciate that the term mobile device refers to devices that can connect to mobile networks, and should not be interpreted as a requirement that the device itself is capable of mobility. A machine-to-machine device, such as a sensor, is considered a mobile device although it may not necessarily be mobile. Transceivers 102 may connect to network 104 through fixed links, and these links may themselves be wireless links that make use of phased array antennae at one or both ends of the wireless link. Although transceivers 102 are illustrated in FIG. 1 as connected to network 104, it should be understood that an access point may connect to network 104 through a wireless connection to another access point that is itself connected to network 104. As such, phased arrays may be used to provide backhaul communication links as well as inter-access point communication links as well as between base-stations.

Although phased arrays can be used in many different network implementations, including in third and fourth generation (3G/4G) mobile networks, such as those supporting the Long Term Evolution (LTE) networking standards defined by the Third Generation Partnership Project (3GPP), the following discussion will be directed to the application of phase array in next generation wireless networks, such as fifth generation wireless networks (5G). This should not be viewed as limiting the scope of applicability of phase array antennas.

In order to provide the performance desired for next generation wireless networks such as 5G, networks may include phased array antennas in transmitters and receivers to allow transmission beams to steered and to allow receivers to be directed in both an azimuth plane as well as an elevation plane. Although the specific field of view (FOV) that can be scanned by the phased array will vary depending upon the particular requirements, generally, the design objective is to allow a main beam to be steered over +/−70° or greater in both the azimuth and elevation plane.

Figure 2:
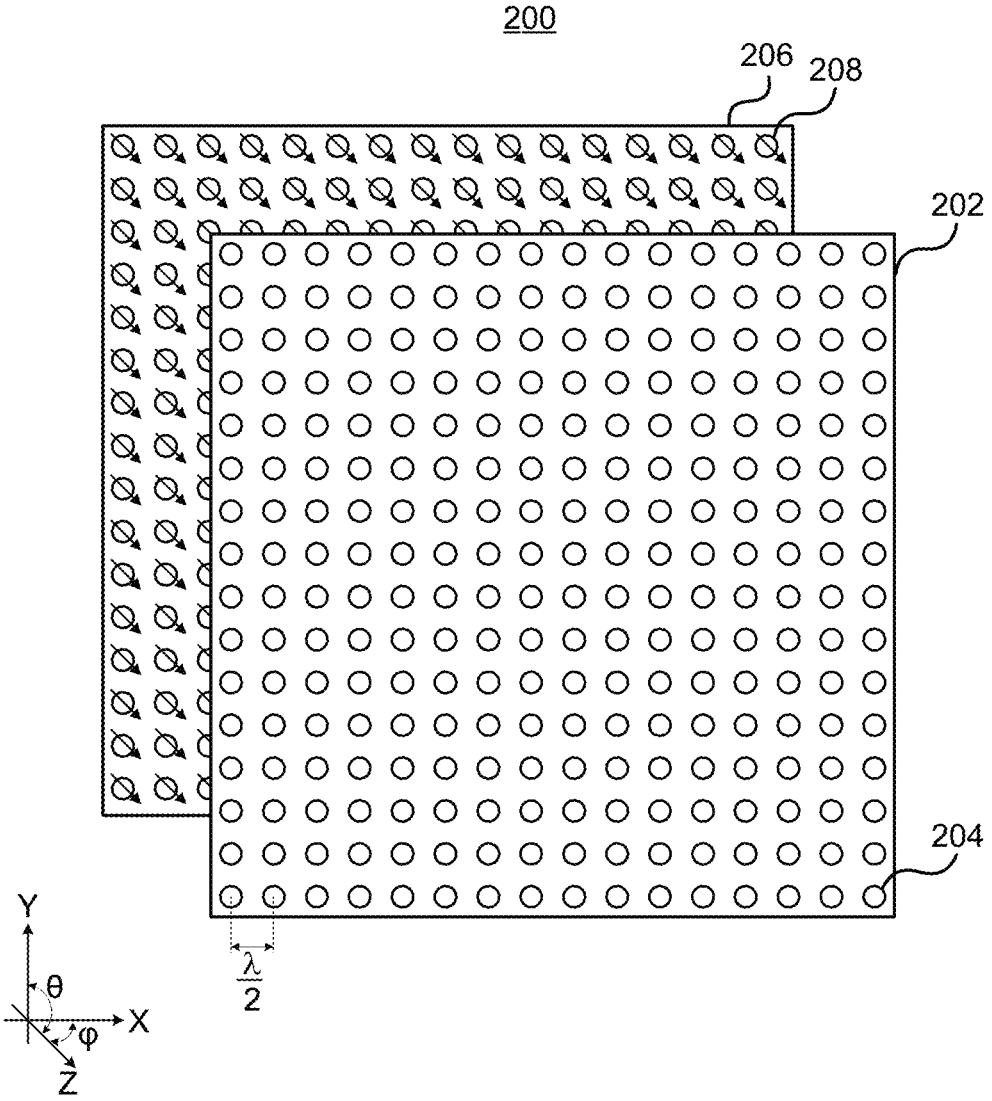
FIG. 2 depicts schematically an antenna array comprising individual phase shifters for each antenna element.

FIG. 2 depicts schematically an antenna array that may be used in a communication network. The antenna array 200 comprises a grid 202 of regularly spaced individual array elements 204, which may also be referred to as antenna elements. Each antenna element 204 is capable of transmitting and/or receiving signals. It is noted that only a single array element 204 is labeled for clarity of FIG. 2. The grid spacing between the individual array elements may vary depending upon design details including the frequency range that the antenna will be used with. The grid spacing may be approximately $\lambda_0/2$, where $\lambda_0$ is the wavelength in free space of the signal that is being transmitted or received at a particular carrier frequency The transmission or reception direction of the antenna 200 can be steered by shifting the phase of the transmitted or received signals for the individual array elements. As depicted in FIG. 2, the grid array 202 is associated with control circuitry 206, which includes a phase shifter 208 for each of the individual array elements. Additional components, for example, for switching between transmit and receive circuitry, amplifiers, etc. may be included in the control circuitry 206.

Figure 3:
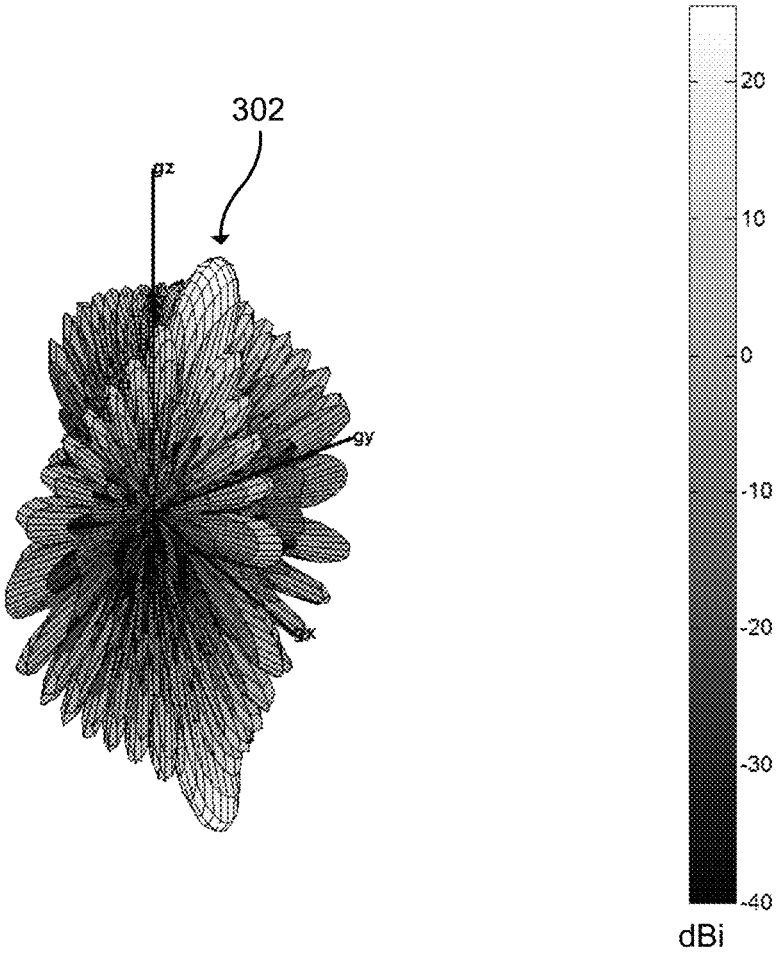
FIG. 3 is a 3D plot of the radiation pattern of a phased array antenna having individual phase shifters for each antenna element with its main beam steered away from its boresight.
Figure 4:
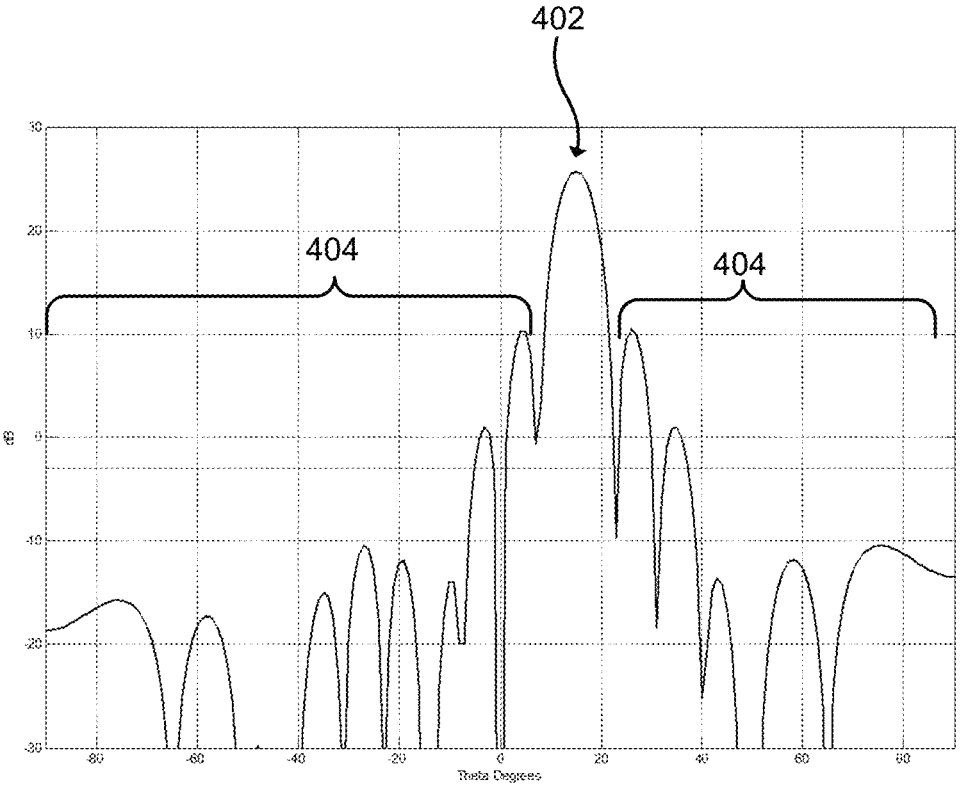
FIG. 4 is a plot of a slice through the 3D plot of FIG. 3 for φ=15° while sweeping over theta ϑ.

FIG. 3 is a 3D plot of the radiation pattern of a typical phased array antenna with its main beam steered away from its boresight. The phased array antenna modeled for calculating the radiation pattern comprises a 16×16 grid of isotropic array elements with a grid spacing of $$\frac{\lambda_0}{2}, \text{ for } \lambda_0 = \frac{c}{86\text{ GHz}}$$

where c is speed of light. The antenna radiation pattern steering at a spatial location of $\vartheta=15°$ and $\varphi=15°$ was calculated using Matlab™. As can be seen in FIG. 3, the radiation pattern or radiated intensity of the antenna is highly directional. The transmission strength for the peak directivity 302 was 25.72 dBi (decibel relative to isotropic), at an operation frequency of 86 GHz. FIG. 4 is a plot of a slice through the 3D plot of FIG. 3 for $\varphi=15°$ while sweeping along theta $\vartheta$. As depicted a main beam 402 occurs at $\vartheta=15°$, $\varphi=15°$. Additionally, the levels of the side lobes 404 are all 13 dBc (decibel relative to a carrier) lower than the main beam.

In order to reduce the number of control circuits required for operating a phased array, individual array elements can be grouped together and each group may be driven by a phase shifter. The phased array described further below overlaps groups of array elements so that each array element is a member of two groups. As described, each array element may be part of a vertical grouping of array elements and a horizontal grouping of array elements. Accordingly, each individual array element is a member of two overlapping groups and as such each individual array element is controlled by two phase shifters. The overlapping vertical and horizontal sub-array arrangement described herein allows a reduction in the number of control circuits required for the phased array antenna since each one of vertical and horizontal sub-array groupings of multiple array elements has a control circuit rather than each individual array element having a dedicated control circuit. As an example, the number of phase shifters for an N×N phased array may be reduced from $N^2$ to 2N, which for a 16×16 phased array antenna would reduce the number of phase shifters by over 85%. The reduction in the control circuitry as well as the relatively simple sub-array architecture may provide a cost reduction, simplify a design process and/or simplify the manufacture of the antenna.

FIG. 5 depicts a schematic of an overlapping linear sub-array. The sub-array 500 comprises a grid of array elements 502. It is noted that only a single array element is labeled for clarity of the figure. The array elements 502 are arranged into a plurality of columns and a plurality of rows. As depicted, the array elements 502 in each column of the grid are grouped together into individual linear groups 504-1-504-N. Similarly, the array elements 502 in each row of the grid are grouped together into individual linear groups 508-1-508-N. Each column group of array elements 504-1-504-N are controlled by respective phase shifter 506-1-506-N, with each of the array elements in a respective column group associated with the same phase shifter, and as such have the same phase shift.

As depicted, the linear array of vertical column groups 504-1-504-N and their associated phase shifters 506-1-506-N provide phase shifts of 0, $\beta_x$, $2\beta_x$, $3\beta_x$, . . . , $(N-1)\beta_x$ resulting in the desired steering angle in an azimuth direction. Similarly, the linear array of horizontal row groups 508-1-508-N and their associated phase shifters 510-1-510-N provide phase shifts of 0, $\beta_y$, $2\beta_y$, $3\beta_y$, . . . , $(N-1)\beta_y$ resulting in the desired steering angle in the elevation angle. Each of the array elements 502 are in overlapping row and column groups and as such are associated with two phase shifters. A phase matrix 512 is shown in FIG. 5 depicting the ideal phase feed values for each array element. As depicted, each of the array elements is fed by a sum of the associated phase shifts. Accordingly, by properly selecting the phase shift values of both phase shifters of rows and columns, it is possible to steer the main beam of the antenna array in both the azimuth and elevation directions with only 2N phase shifters as opposed to $N^2$ phase shifters. However, it is necessary to adjust the steering angles used to determine the required phase shift to account for the combination of the two phase shifts at each array element.

Figure 6:
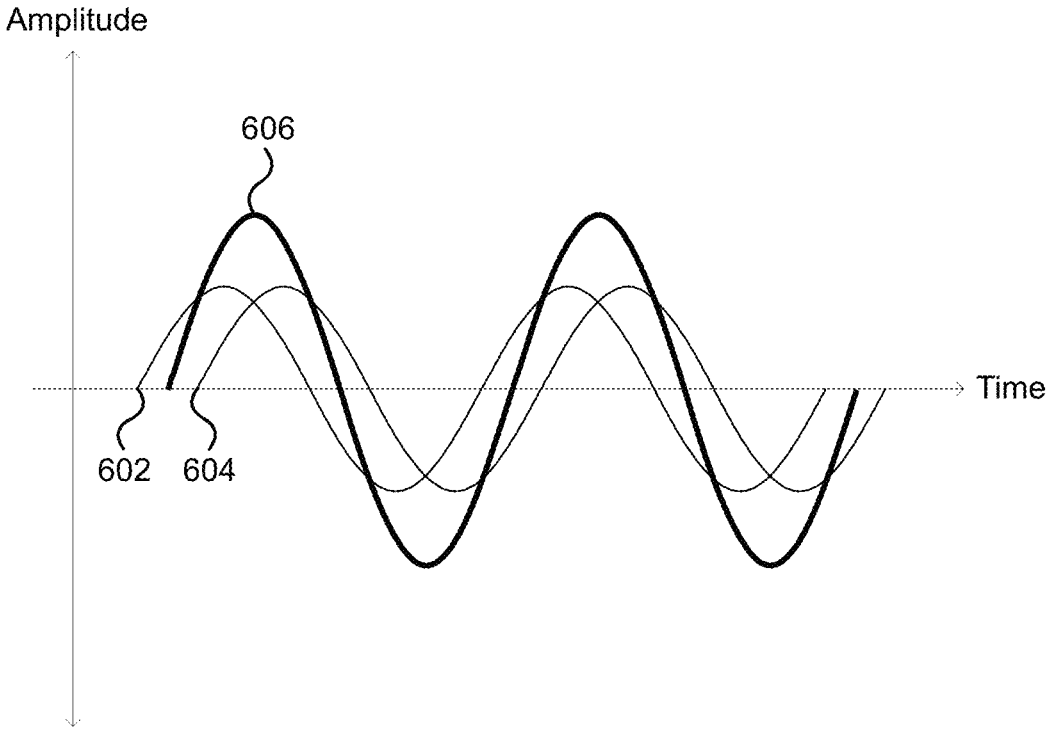
FIG. 6 depicts a vector plot of feed signals of a radiating element in a time domain.

FIG. 6 depicts a schematic of feed signals of a radiating element in a time domain. As depicted two sinusoidal signals 602, 604 combine linearly to produce a resultant combined signal 606.

Figure 7:
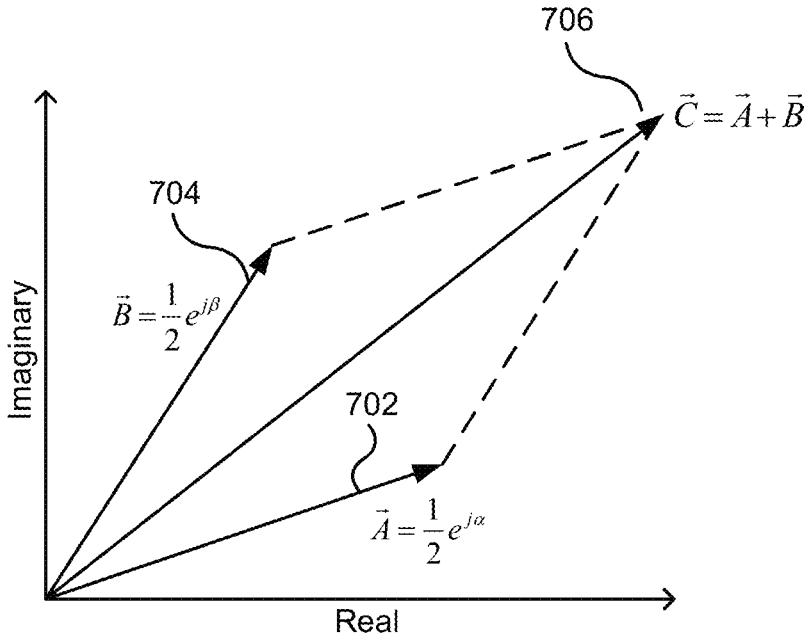
FIG. 7 depicts a schematic of feed signals of a radiating element in a frequency domain.

FIG. 7 depicts a schematic of feed signals combining at a radiating element in a frequency domain. As depicted two feed signals A 702 and B 704 may combine linearly to produce signal C 706. The individual signals may be described by:

$$\vec{A} = \tfrac{1}{2}e^{j\alpha} \tag{1}$$

$$\vec{B} = \tfrac{1}{2}e^{j\beta} \tag{2}$$

$$\vec{C} = \vec{A} + \vec{B} \tag{3}$$

The combined signal C is described by:

$$\left|\vec{C}\right| = \sqrt{\frac{1}{2} + \frac{1}{2}\cos(\alpha - \beta)} \tag{4}$$

$$< \vec{C} = \tan^{-1}\left(\frac{\sin\alpha + \sin\beta}{\cos\alpha + \cos\beta}\right) = \frac{\alpha + \beta}{2} \tag{5}$$

Accordingly, if each sub array is fed with double the original phase shift required to provide the desired phase shift assuming the column and rows were fed independently, it will be possible to deliver the ideal phase shift values to each of the array elements. That is, if $\alpha=2\beta_x$ and $\beta=2\beta_y$ then the combination of the two phase shifts at each array element will be $\beta_x+\beta_y$. By providing each column group and row group with twice the phase shift required by the column or row group individually, the combination will result in the ideal phase shift value being provided to the array elements. $\beta_x$ and $\beta_y$ are the phase progressions required in both x and y direction of an un-overlapping rectangular phased array. $\beta_x$ and $\beta_y$ are defined by:

$$\begin{cases} \beta_x = -k \cdot d_x \sin\vartheta_o \cos\varphi_o \\ \beta_y = -k \cdot d_y \sin\vartheta_o \sin\varphi_o \end{cases} \tag{6}$$

Where:

κ is a phase number defined by $$k = \frac{2 \cdot \pi}{\lambda};$$

and $\vartheta_o$ and $\varphi_o$ are the beam steering directions.

As described above, if each array element is fed by two phase shift values, it is possible to provide ideal phase shift values to each array element in order to steer the array's main beam in both the azimuth and elevation directions. Providing the ideal phase shift values, or values that are close to a approaching the ideal phase shift values, prevents, or at least reduces grating lobes that traditionally result from grouping a plurality of array elements together for control by a reduced number of phase shifters resulting large inter-subarray spacing in both the x and y direction. In order to provide the two individual phase shift values to the same array element, two separate feed networks are required. According to equation 4, it may be necessary to scale input signals so that the magnitude of array signals are uniform. Further, where $\alpha-\beta$ approaches $\pi$, it may be preferable to introduce a deviation into one or both of $\alpha$ and $\beta$ rather than require large scaling. As described with reference to FIGS. 8 to 10 below, the feed network for feeding the column groups of array elements may be formed in a layer above, or below, a second layer in which the feed network for feeding the row groups of array elements is formed.

Figure 8:
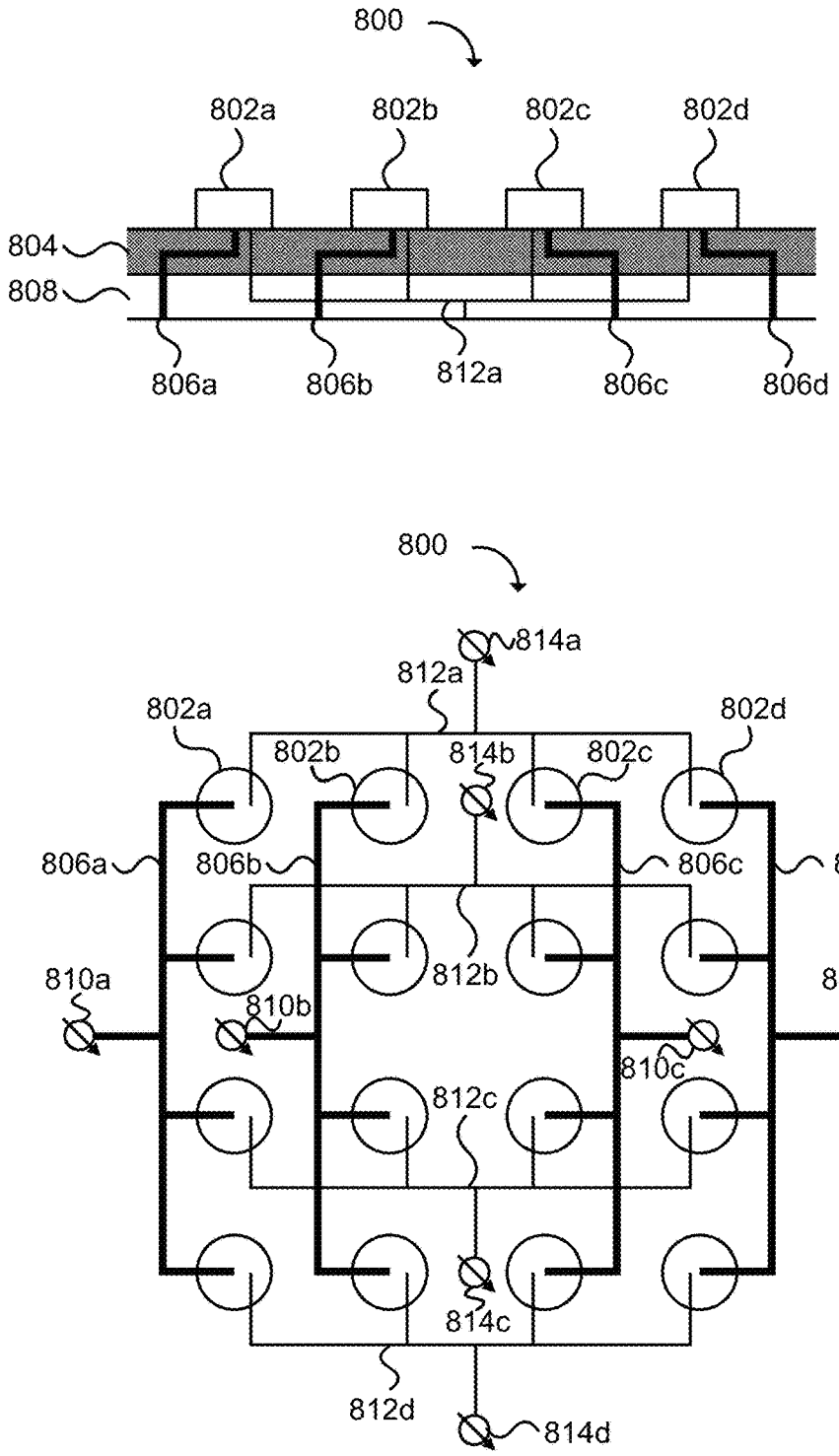
FIG. 8 depicts a schematic of a feed network for an overlapping linear sub-array.

FIG. 8 depicts a schematic of a feed network for overlapping linear sub-arrays of an antenna array structure. The antenna array structure 800 comprises the array elements 802*a*, 802*b*, 802*c*, 802*d* (only one row of array elements are labeled for clarity o the figure and referred to collectively as array elements 802) printed on a substrate. The array elements 802 are depicted as circles, however the actual radiating elements may be provided by various physical radiating element designs, such as isotropic radiating elements, patch radiating elements as well as other designs depending upon application requirements. The array elements 802 are arranged in a grid pattern of a plurality of vertical columns and horizontal rows. Each of the plurality of columns and rows comprise a plurality of array elements 802, with each array element being associated with a single particular column and row. The plurality of columns array elements 802 are fed by a first feed network comprising a plurality column signal feeds 806*a*, 806*b*, 806*c*, 806*d* (referred to collectively as column signal feeds 806), each feeding a respective column grouping of array elements. The column signal feeds 806 are formed in a first substrate layer 804. The column signal feeds 806 may be formed as substrate-integrated waveguide (SIW) or microstrips as depicted within the first substrate layer 804.

Each individual column signal feed is associated with a respective control component, depicted as a phase shifter 810*a*, 810*b*, 810*c*, 810*d* for feeding all array elements with the same phase shift. That is, each of array elements in the first vertical column group are fed by a common column signal feed 806*a* associated with a single phase shifter 810*a*. A second row grouping of array elements 802 is overlapped with the column grouping so that individual array elements are part of both a column grouping and a row grouping. Individual array elements 802 in a particular column grouping are overlapped with different row groupings, and similarly, individual array elements 802 in a row grouping overlap with different column groupings.

Each row grouping of array elements is fed by second feed network of respective row signal feeds 812*a*, 812*b*, 812*c*, 812*d* (referred to collectively as row signal feeds 812) that are formed in a second substrate layer 808 separate from the first layer. As with the column signal feeds 806, the row signal feeds 812 may be formed as SIW or microstrips, which are depicted in FIG. 8, within the second substrate layer 808. The phase of individual row subarrays are controlled by phase shifters 814*a*, 814*b*, 814*c* and 814*d*. Forming the first and second feed networks in separate layers allows the individual signal feeds to be properly routed to the individual array elements without crossing other signal feeds. Accordingly each array element can be fed by two different phase shifts obtaining sum of the phases. It is noted that although the column signal feeds 806 and row signal feeds 812 are depicted as being of different widths, the actual dimensions of the signal feeds may be the same as required by the particular design. The different thickness of lines of FIG. 8 is intended to provide a distinction between column signal feeds 806 and row signal feeds 812.

Although FIG. 8 depicts the column signal feeds 806 of the first feed network being formed in the first substrate layer 804, and the row signal feeds 812 of the second feed network being formed in the second substrate layer 808, it is possible for the layers to be reversed with the row signal feeds being formed in the first layer 804 and the column signal feeds being formed in the second layer 808. The array elements 802 are depicted as being formed on a top surface of the of the first substrate 802 with the column signal feeds 806 and row signal feeds 812 coupling to the array elements 802 at an interface of the array elements 802 and first layer 804. It is possible for the array elements 802 to extend into the first layer 804 or extend completely through the first layer and contact, or extend into, the second substrate layer 808, which may eliminate the need for signal feeds formed in the lower second substrate layer to pass fully through the upper first substrate layer in order to couple to the array elements 802.

Figure 9:
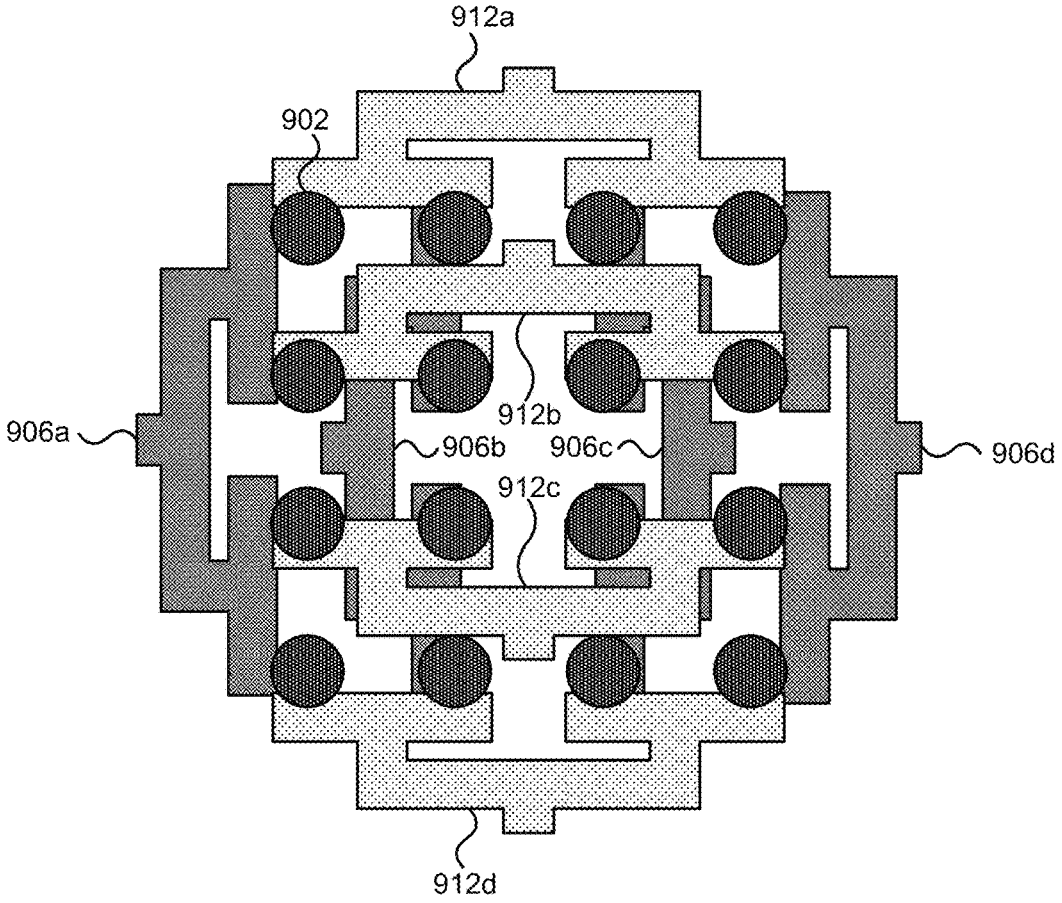
FIG. 9 depicts a further schematic of a feed network for an overlapping linear sub-array.

FIG. 9 depicts a further schematic of a feed network for an overlapping linear sub-array of an antenna array structure. The antenna array structure 900 is similar to the antenna array structure 800. In particular, the antenna array structure 900 comprises a plurality of radiating array elements 902 arranged in a grid pattern of a plurality of columns and rows. The antenna array structure 900 comprises a first feed network arranged in a first substrate layer (not depicted in FIG. 9) and a second feed network arranged in a second substrate layer (not depicted in FIG. 9). As described above with reference to FIG. 8, the first feed network comprises a plurality of column signal feeds 906*a*, 906*b*, 906*c*, 906*d* (referred to collectively as column signal feeds 906), each associated with a respective control component such as a phase shifter (not depicted in FIG. 9). Each of the column signal feeds 906 provides a feed signal to a plurality of array elements that are arranged within the same column of the grid. Similarly, the second feed network comprises a plurality of row signal feeds 912*a*, 912*b*, 912*c*, 912*d* (referred to collectively as row signal feeds 912), each associated with a respective control component such as a phase shifter (not depicted in FIG. 9). Each of the row signal feeds 906 provides a feed signal to a plurality of array elements that are arranged within the same row of the grid. Accordingly, as described above, each array element is fed by two signals, a column signal feed and row signal feed, which are combined at the array elements. In contrast to FIG. 8, which depicted the feed networks as being provided by microstrips, the feed networks of the column signal feeds 906 and row signal feeds 912 are provided as substrate integrated waveguides (SIWs).

FIGS. 8 and 9 have described the column and row signal feeds as being provided in the same manner. That is, FIG. 8 depicts the column and row signal feeds as both being provided by microstrips while FIG. 9 depicts the column and row signal feeds as both being provided by SIWs. It is possible for a combination of the two techniques to be used in a single antenna array. As an example, the column signal feeds may be provided by microstrips in a first substrate layer and the row signal feeds may be provided by SIWs in a second substrate layer.

Figure 10:
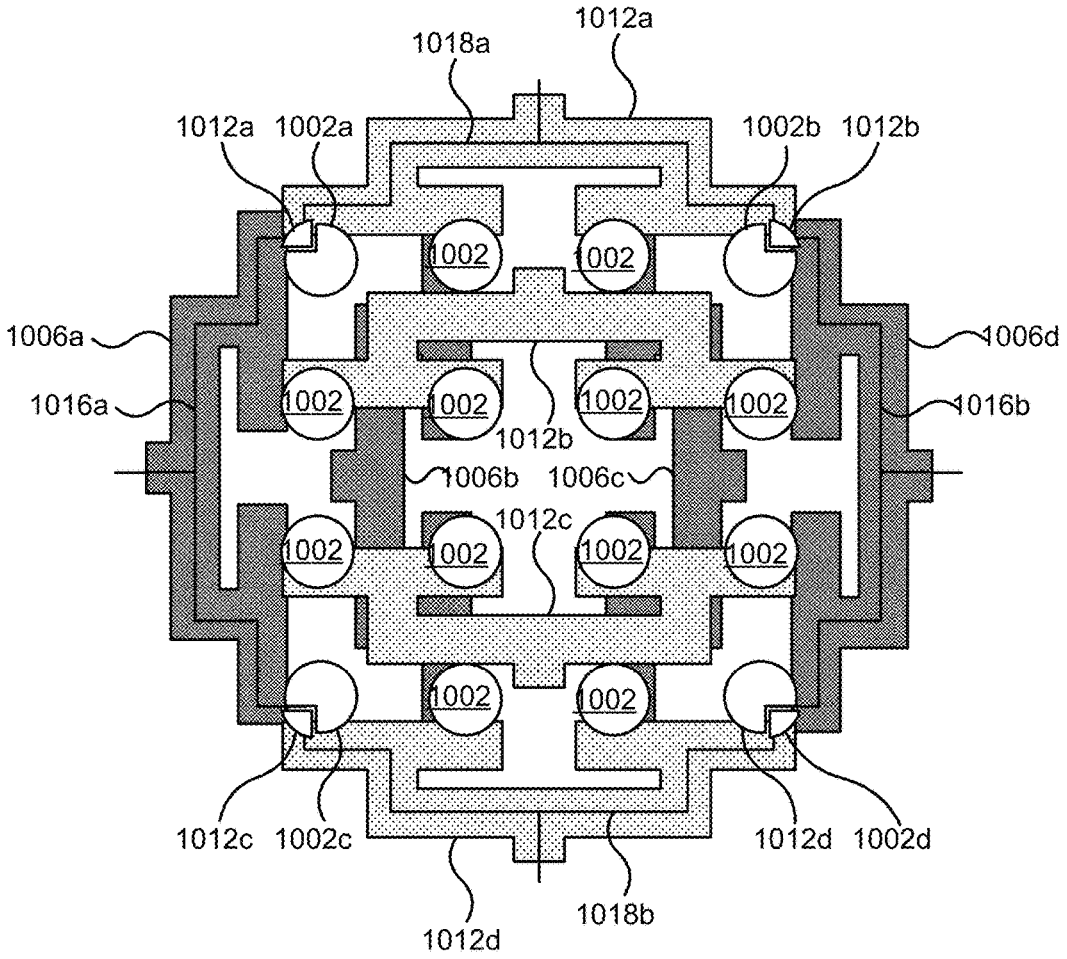
FIG. 10 depicts a schematic of a feed network for a overlapping linear sub-array.

FIG. 10 depicts a schematic of a feed network for an overlapping linear sub-array of a dual antenna array structure. The dual antenna array structure 1000 comprises overlapping array element groups as described above. In contrast to the antenna array structures 800, 900 described above, which provided a single band antenna, the antenna array structure 1000 may provide a dual band antenna. The antenna structure 1000 comprises a first or primary set of array elements 1002, 1002*a*, 1002*b*, 1002*c*, 1002*d* (referred to collectively as primary array elements 1002), which are arranged in a grid pattern of columns and rows as described above with reference to the antenna array structures described above with reference to FIGS. 8 and 8. A subset of the primary array elements are broken into two separate radiating elements, namely the primary radiating elements 1002*a*, 1002*b*, 1002*c*, 1002*d* and secondary radiating elements 1012*a*, 1012*b*, 1012*c*, 1012*d* (referred to collectively as secondary array elements 1012). As with the primary array elements 1002, the secondary array elements 1012 are also arranged in a grid pattern of a plurality of columns and rows. As depicted, the spacing between the primary array elements 1002 is smaller than that of the element spacing between secondary array elements 1012. Accordingly, the primary array elements may be used in the transmission and/or reception of signals at a first frequency while the secondary array elements may be used in the transmission and/or reception of signals at a second frequency that is lower than the first frequency. As described further below, both the primary array elements 1002 and the secondary array elements may each be associated with overlapping column and row groups, which allow both main lobe of the primary frequency as well as the main lobe of the secondary frequency to be independently steered.

As depicted in FIG. 10, the primary array elements 1002 are fed by a first feed network of column signal feeds 1006*a*, 1006*b*, 1006*c*, 1006*d* and a second feed network of row signal feeds 1012*a*, 1012*b*, 1012*c*, 1012*d*. The column signal feeds 1006 of the first feed network are depicted as waveguides integrated in a first substrate layer and the row signal feeds 1012 of the second feed network are depicted as waveguides integrated in a second substrate layer. Secondary feed networks for providing column signal feeds and row signal feeds to the secondary array elements 1012 may be provided within the first and second feed networks. The secondary feed networks are depicted as microstrips within the waveguides of the first and second feed networks. In particular, a first column signal feed 1016*a* for feeding the first column of the secondary array elements, namely secondary array elements 1012*a*, 1012*c*, is located with the first column signal feed SIW 1006*a* that feeds the first column of primary array elements 1002. The first column signal feed 1016*a* may be provided as a microstrip within the SIW 1006*a*. A second column signal feed 1016*b* for feeding the second column of the secondary array elements, namely secondary array elements 1012*b*, 1012*d*, is located with the associated column signal feed SIW, which in the embodiment depicted in FIG. 10 is the fourth column signal feed waveguide 1012*d*, that feeds the respective column of primary array elements 1002. The second column signal feed 1016*b* may be provided as a microstrip within the SIW 1006*b*. Similarly, row groupings of the secondary array elements 1012 are fed by microstrips 1018*a*, 1018*b* located within corresponding row signal feed SIWs 1012*a*, 1012*d* of the feed networks of the primary array elements.

The dual-mode antenna array structure 1000 described above allows the main beam of the primary array elements 1002 to be steered in both the azimuth and elevation angles simultaneously. The main beam of the secondary array elements 1012 can also be steered in both the azimuth and elevation angles simultaneously. The primary and secondary main beams may be steered independent from each other.

Figure 11:
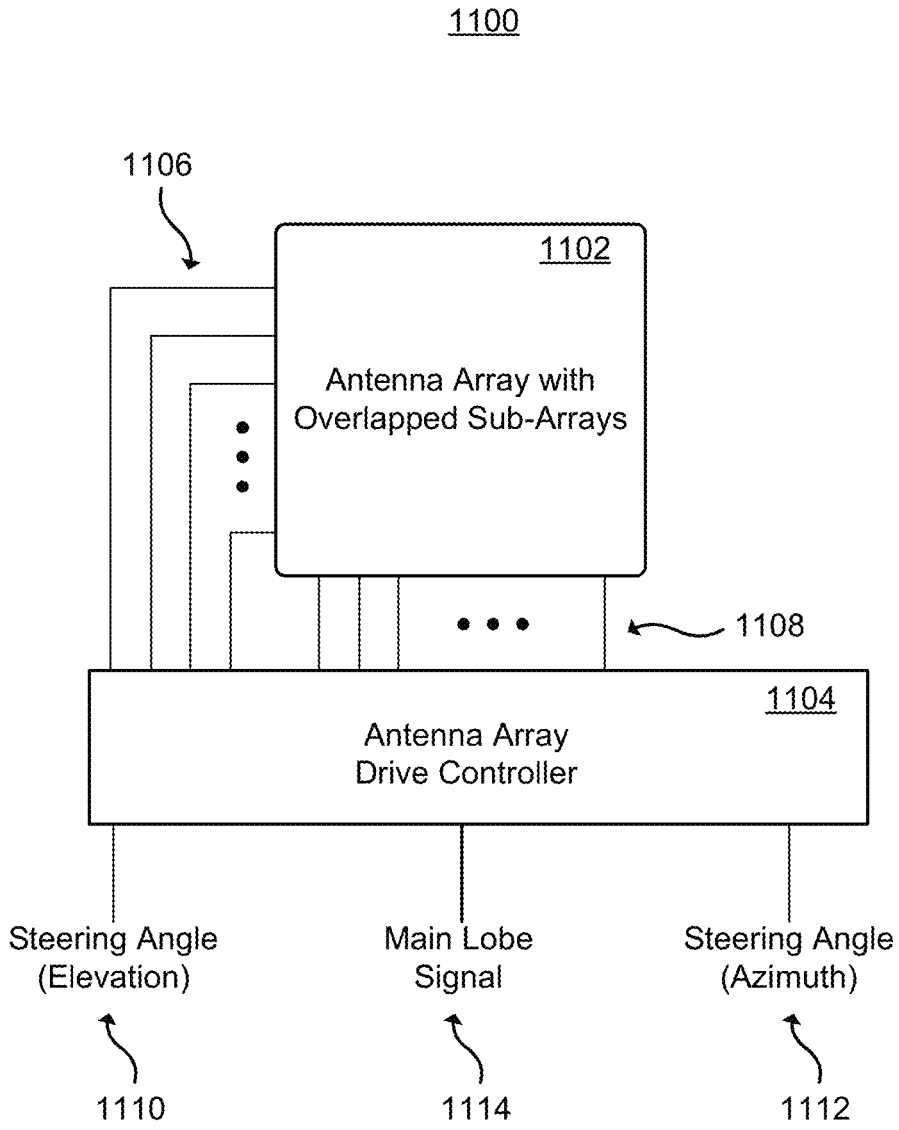
FIG. 11 depicts a phased array system.

FIG. 11 depicts a phased array system. The phased array system 1100 comprises an antenna array structure 1102 that has overlapped sub-arrays, such as one of the antenna arrays 800, 900 described above. The array structure 1102 comprises a number of column signal feeds 1106 and a number of row signal feeds 1108 that provide the signals with appropriate phase shifts in order to provide the desired steering angle. The system 1100 further comprises an antenna array drive controller 1104. The drive controller 1104 receives indications of desired steering angles for both the elevation 1110 and azimuth 1112 and determines the required phase shifts for the column signal feeds 1106 and the row signal feeds 1108. The controller may be provided by, for example, a programmable microcontroller, field programmable gate array (FPGA), application specific integrated circuit (ASIC).

The controller 1104 may determine the required phase shift of the column groupings in order to provide the desired steering angle $\vartheta_0$ and $\varphi_o$ assuming the column groupings of array elements are not overlapped, as well as the phase shift of the row groupings in order to provide the desired elevation steering angle assuming the row groupings of array elements are not overlapped. As described above, the required phase shifts for non-overlapping sub-arrays are then doubled for feeding the overlapping sub-arrays of the antenna array 1102. The antenna array drive controller 1104 may receive a main lobe signal 1114 to be transmitted by the antenna array. The main lobe signal 1114 is phase shifted according to the determined values and phase shifted signals are provided to column and row signal feeds 1106, 1108. The phase shifters may form part of the controller, in which case, the phase shifted signals are provided to the antenna array. Alternatively, the phase shifters may be separate from the controller 11004 and the controller can provide signals to the phase shifters in order to provide the required phase shift to the main lobe signal 1114.

It is possible to apply additional techniques to improve desired characteristics of the signal. For example, amplitude tapering may be applied in order to further reduce side lobe levels. The system 1100 provides an antenna that can be steered in both azimuth and elevation directions over a large field of view while reducing grating lobe effects.

The system 1100 is described above with regard to a single band antenna such as provided by the antenna arrays 800, 900. The system 1100 may include a dual band antenna array, such as antenna array 1000. In the case of a dual band antenna, the controller may receive separate steering angles for the secondary beam, or the same steering angles may be used for both the primary and secondary bands of the antenna.

The above has described antenna arrays and systems with a primary focus on transmitting signals. One of ordinary skill in the art will readily appreciate that the same antenna array structures 800, 900, 1000 may also be used in receiving signals.

Figure 12:
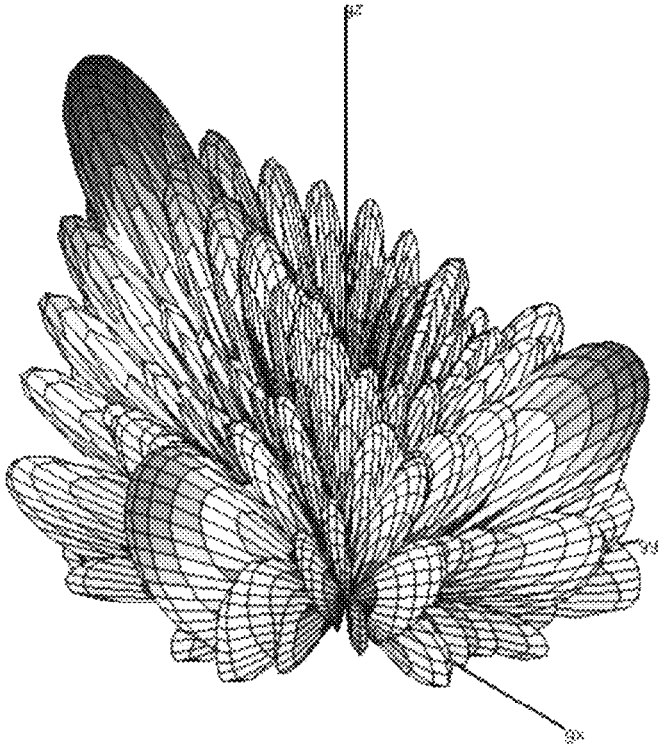
FIG. 12 depicts the simulated radiating pattern for a 16×16 antenna array having patch elements and steered to 30 degrees in elevation.
Figure 13:
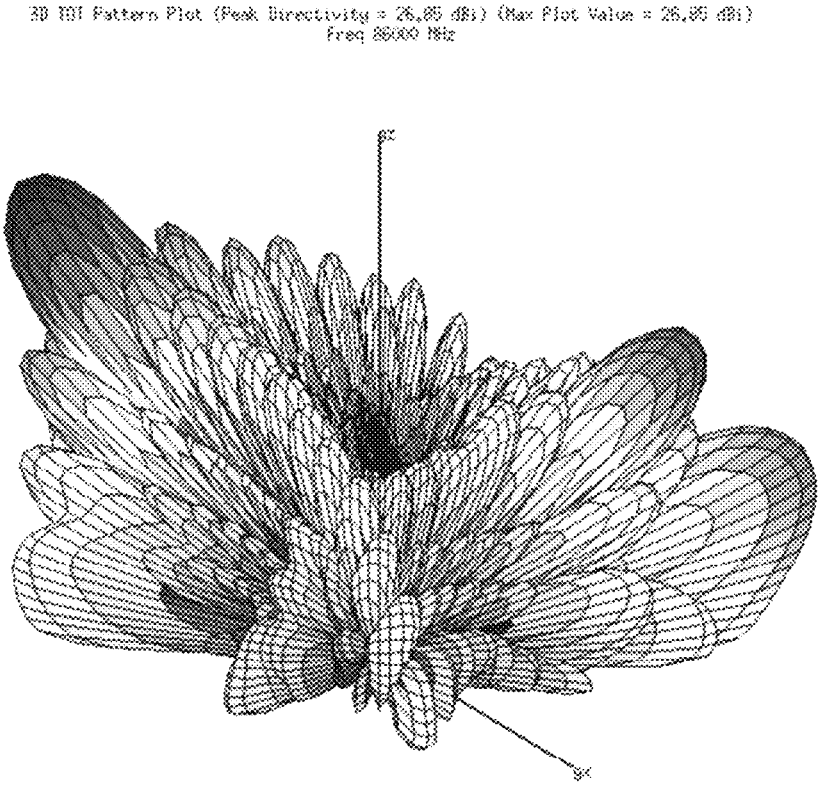
FIG. 13 depicts the simulated radiating pattern for a 16×16 antenna array having patch elements and steered to 40 degrees in elevation.
Figure 14:
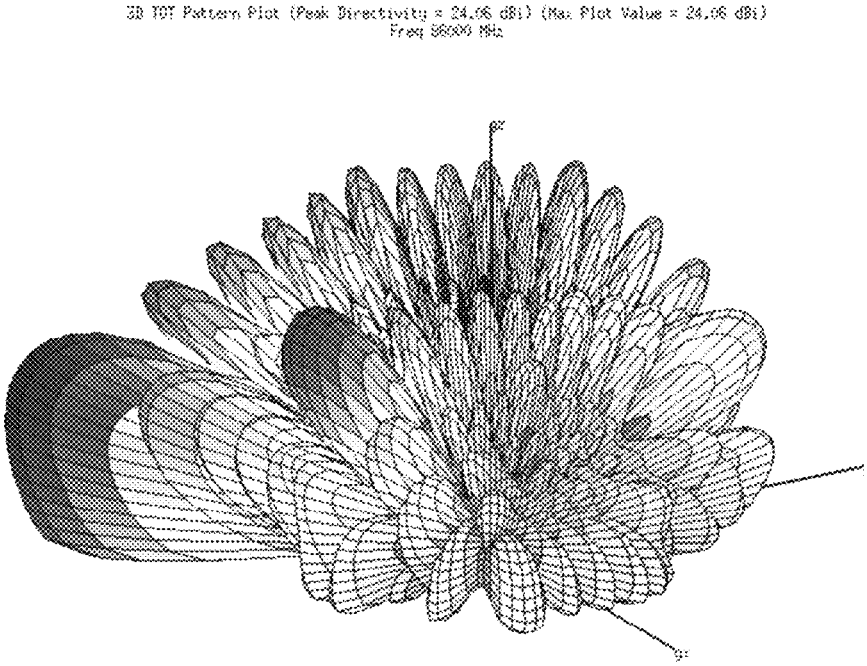
FIG. 14 depicts the simulated radiating pattern for a 16×16 antenna array having patch elements and steered to 70 degrees in elevation.

A 16×16 antenna array was simulated with both isotropic and patch radiating elements. The results of the simulation are depicted in Table 1 below. FIG. 12 depicts the simulated radiating pattern for a 16×16 antenna array having patch elements and steered to 30 degrees in elevation. FIG. 13 depicts the simulated radiating pattern for a 16×16 antenna array having patch elements and steered to 40 degrees in elevation. FIG. 14 depicts the simulated radiating pattern for a 16×16 antenna array having patch elements and steered to 70 degrees in elevation.

TABLE 1

Main lobe and side lobe levels for different array elements and steering angles

| Array element | Steering Angle | Main lobe (dBi) | Side lobe level (dB) |
|---|---|---|---|
| Isotropic | 15 | 24.60 | 10 |
| Isotropic | 30 | 23.67 | 10 |
| Isotropic | 40 | 23.17 | 10 |
| Isotropic | 70 | 20.64 | 6 |
| Patch | 15 | 27.87 | 10 |
| Patch | 30 | 27.34 | 10 |
| Patch | 40 | 26.85 | 10 |
| Patch | 70 | 24.06 | 6 |

Although the above describes an electronically steerable antenna array, it is possible to use the antenna array structure of overlapping sub-arrays to provide an antenna that is pointed in a fixed direction by determining the required phase shifts and fixing the phase shifts, rather than providing variable phase shift control components. Further, although described with reference to N×N arrays, arrays of N×M radiating elements are considered.

The above description provides various specific implementations for a phased array antenna. The specific embodiments have been simulated for reception and transmission in the approximately 71 GHz-86 GHz frequency range intended for use in possible 5G communication networks. It will be appreciated that the same technique of tiling rectangular sub-array groupings of individual array elements may be applied to phased array for communication networks operated at other frequency ranges.

The present disclosure provided, for the purposes of explanation, numerous specific embodiments, implementations, examples and details in order to provide a thorough understanding of the invention. It is apparent, however, that the embodiments may be practiced without all of the specific details or with an equivalent arrangement. In other instances, some well-known structures and devices are shown in block diagram form, or omitted, in order to avoid unnecessarily obscuring the embodiments of the invention. The description should in no way be limited to the illustrative implementations, drawings, and techniques illustrated, including the exemplary designs and implementations illustrated and described herein, but may be modified within the scope of the appended claims along with their full scope of equivalents.

While several embodiments have been provided in the present disclosure, it should be understood that the disclosed systems and components might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

What is claimed is:

1. An antenna array comprising;

a plurality of array elements arranged in an N×M grid;

a first feed network in a first substrate layer comprising N radio frequency column signal feeds, each column signal feed connected to provide a respective column drive signal to M array elements of a respective one of N columns of the N×M grid, wherein the column drive signal provided by each column signal feed comprises a main signal phase shifted by a respective column-dependent phase shift;

a second feed network in a second substrate layer comprising M radio frequency row signal feeds, each row signal feed connected to provide a respective row drive signal to N array elements of a respective one of M rows of the N×M grid, wherein the row drive signal provided by each row signal feed comprises the main signal phase shifted by a respective row-dependent phase shift; and each array element, being configured to combine the respective column drive signal provided to the array element with the respective row drive signal provided for the array element to produce an output signal for transmission by the array element, the output signal comprising the main signal with a phase that is a sum of the column-dependent phase shift and the row-dependent phase shift for the column and row of the array element;

where:

N and M are integers greater than 1.

2. The antenna array of claim 1, wherein the plurality of radio frequency column signal feeds are provided by microstrips within the first substrate layer.

3. The antenna array of claim 1, wherein the plurality of radio frequency column signal feeds are provided by substrate integrated waveguides (SIWs) within the first substrate layer.

4. The antenna array of claim 1, wherein the plurality of radio frequency row signal feeds are provided by microstrips within the first substrate layer.

5. The antenna array of claim 1, wherein the plurality of radio frequency row signal feeds are provided by substrate integrated waveguides (SIWs) within the first substrate layer.

6. The antenna array of claim 1, wherein the plurality of array elements are provided by isotropic array elements.

7. The antenna array of claim 1, wherein the plurality of array elements are provided by patch array elements.

8. The antenna array of claim 1, further comprising a plurality of phase shifters, each of the phase shifters being associated with a respective one of the plurality of radio frequency column signal feeds and the plurality of radio frequency row signal feeds.

9. The antenna array of claim 8, wherein N=M.

10. The antenna array of claim 8, wherein the column-dependent phase shift applied to the main signal in respect of each column drive-signal is (n−1) α and the the row-dependent phase shift applied to the main signal in respect of each row drive-signal is (m−1) β, where:

n specifies column location progressively increasing from a first column to an Nth column of the N×M grid, with 1≤n≤N:

m specifies row location progressively increasing from a first row to an Mth row of the N×M grid, with 1≤m≤M:

α is a column phase shift amount;

β is a row phase shift amount:

$\alpha=2\beta_x$ and $\beta=2\beta_y$, where:

$$\begin{cases} \beta_x = -k \cdot d_x \sin\theta_o \cos\varphi_o \\ \beta_y = -k \cdot d_y \sin\theta_o \sin\vartheta_o \end{cases}$$

κ is a phase number defined by $$k = \frac{2 \cdot \pi}{\lambda};$$

and $\vartheta_o$ and $\varphi_o$ are beam steering directions.

11. The antenna array of claim 1, further comprising:

a plurality of secondary array elements arranged in a secondary grid having a spacing between secondary array elements greater than a spacing between the array elements of the grid, a third feed network in the first substrate layer comprising a plurality of radio frequency secondary column signal feeds, each radio frequency secondary column signal feed coupled to secondary array elements of a respective one of the plurality of columns of the secondary grid; and a fourth feed network in the second substrate layer comprising a plurality of radio frequency secondary row signal feeds, each radio frequency secondary row signal feed coupled to secondary array elements of a respective one of the plurality of rows of the secondary grid.

12. A phased array system comprising:

an antenna array comprising:

a plurality of array elements arranged in an N×M grid;

a first feed network in a first substrate layer comprising N radio frequency column signal feeds, each column signal feed connected to M array elements of a respective one of a plurality of columns of the N×M grid;

a second feed network in a second substrate layer comprising M radio frequency row signal feeds, each row signal feed connected to N array elements of a respective one of a plurality of rows of the N×M grid;

a respective column phase shifter connected to each column signal feed: and a respective row phase shifter connected to each row signal feed, each array element being configured to combine a respective column drive signal received on the column signal feed connected to the array element with a respective row drive signal received on the row signal feed connected to the array element to produce an output signal for transmission by the array element; and a controller configured to:

determine respective column-dependent phase shifts to be applied to a main signal for each of the column signal feeds and respective row-dependent phase shifts to be applied to the main signal for each of the row signal feeds to enable the output signals transmitted by the plurality of array elements to collectively form a main beam with a desired steering angle; and cause the column phase shifters to apply the respective column-dependent phase shifts to the main signal to output the respective column drive signals for the antenna elements and cause the row phase shifters to apply the respective row-dependent phase shifts to the main signal to output the respective row drive signals for the array elements, where:

N and M are integers greater than 1.

13. The phased array system of claim 12, wherein the phased array system comprises a dual-band phased array system, wherein the antenna array comprises a plurality of primary array elements, each primary array element coupled to the first and second feed networks; and a plurality of secondary array elements, wherein a spacing between secondary array elements is greater than a spacing between the primary array elements:

the antenna array further comprising:

a third feed network in the first substrate layer comprising a plurality of radio frequency secondary column signal feeds, wherein each radio frequency secondary column signal feed coupled to secondary array elements of a respective one of the plurality of columns of the subset of array elements; and a fourth feed network in the second substrate layer comprising a plurality of radio frequency secondary row signal feeds, wherein each radio frequency secondary row signal feed coupled to secondary array elements of a respective one of the plurality of rows of the subset of array elements.

14. The phased array system of claim 13, wherein the plurality of phase shifters are part of the controller.

15. The phased array system of claim 12, wherein the plurality of radio frequency column signal feeds are provided by one of:

microstrips within the first substrate layer; and substrate integrated waveguides (SIWs) within the first substrate layer.

16. The phased array system of claim 12, wherein the plurality of radio frequency row signal feeds are provided by one of:

microstrips within the first substrate layer; and substrate integrated waveguides (SIWs) within the first substrate layer.

17. The phased array system of claim 16, wherein the column-dependent phase shift applied to the main signal in respect of each column drive-signal is (n−1) α and the the row-dependent phase shift applied to the main signal in respect of each row drive-signal is (m−1) β, where:

n specifies column location progressively increasing from a first column to an Nth column of the N×M grid, with $1 \leq n \leq N$:

m specifies row location progressively increasing from a first row to an Mth row of the N×M grid, with $1 \leq m \leq M$;

α is a column phase shift amount:

β is a row phase shift amount;

$\alpha = 2\beta_x$ and $\beta = 2\beta_y$, where:

$$\begin{cases} \beta_x = -k \cdot d_x \sin\theta_o \cos\varphi_o \\ \beta_y = -k \cdot d_y \sin\theta_o \sin\vartheta_o \end{cases}$$

κ is a phase number defined by $$k = \frac{2 \cdot \pi}{\lambda};$$

and $\vartheta_o$ and $\varphi_o$ are beam steering directions.

* * * * *